US010506863B2

(12) United States Patent
Bartlett

(10) Patent No.: US 10,506,863 B2
(45) Date of Patent: Dec. 17, 2019

(54) TOILETRY APPLICATOR

(71) Applicant: Tessy Plastics Corporation, Elbridge, NY (US)

(72) Inventor: Mark Bartlett, North East, PA (US)

(73) Assignee: Tessy Plastics Corporation, Elbridge, NY (US)

( * ) Notice: Subject to any disclaimer, the term of this patent is extended or adjusted under 35 U.S.C. 154(b) by 349 days.

(21) Appl. No.: 15/343,848

(22) Filed: Nov. 4, 2016

(65) Prior Publication Data

US 2017/0127798 A1 May 11, 2017

Related U.S. Application Data

(60) Provisional application No. 62/251,452, filed on Nov. 5, 2015.

(51) Int. Cl.
*A45D 40/04* (2006.01)
*A45D 40/12* (2006.01)

(52) U.S. Cl.
CPC ..... *A45D 40/04* (2013.01); *A45D 40/12* (2013.01)

(58) Field of Classification Search
CPC ..... A45D 40/04; A45D 40/12; A45D 40/02; A45D 40/06; A45D 2040/208; B65D 83/0011; B65D 83/0016; B65D 83/0022; B65D 83/0027
See application file for complete search history.

(56) References Cited

U.S. PATENT DOCUMENTS 4,595,124 A * 6/1986 Duval ..... B65D 83/0011 222/39
4,702,399 A * 10/1987 Davis ..... A45D 40/04 222/390
5,863,142 A * 1/1999 Lhuisset ..... A45D 34/042 222/390
6,299,369 B1 10/2001 Baines et al.
6,598,767 B2 7/2003 Baines et al.
7,901,152 B2 * 3/2011 Hines ..... A47L 25/08 401/172
8,297,867 B2 * 10/2012 Nasu ..... A45D 40/04 222/390
8,690,467 B2 4/2014 Baines et al.
2001/0002962 A1 6/2001 Baines et al.

* cited by examiner

*Primary Examiner* — David J Walczak
(74) *Attorney, Agent, or Firm* — Barclay Damon LLP

(57) ABSTRACT

A deodorant applicator includes a housing, a screw with a threaded shaft, and an elevator assembly. The elevator assembly includes a receptacle and a threaded portion formed by a plurality of segments or ratchet discs. The ratchet discs can each be slid or pushed onto the screw to form a stack. The receptacle is slid over the stack of ratchet discs so that the stack of ratchet discs forms a threaded portion of the elevator assembly.

19 Claims, 23 Drawing Sheets

TOILETRY APPLICATOR

CROSS-REFERENCE TO RELATED APPLICATION

This application claims the benefit and priority of U.S. Patent Application Ser. No. 62/251,452, filed Nov. 5, 2015, and entitled TOILETRY APPLICATOR, the entirety of which is incorporated herein by reference.

FIELD OF THE INVENTION

The invention relates to an applicator and, more particularly, to a deodorant applicator.

BACKGROUND OF THE INVENTION

Plastics are used to make a variety of items. For example, plastics can be used to make a variety of toiletry items, such as deodorant applicators, among others. As illustrated by FIGS. 1-3B, typically, a deodorant applicator 2 includes a housing 4, a threaded screw 6, including a screw shaft 8 and a screw knob 10, and a threaded elevator or receptacle 12 with an integral threaded section 14. The deodorant (not shown), gel or solid, is deposited on the receptacle 12 and the screw 6 is inserted through the center of the receptacle 12 so that when the knob 10 is rotated, the receptacle 12 rises, dispensing the deodorant. This threaded receptacle 12 is typically formed in a mold with a threaded insert. In order to eject the molded elevator from the mold, the insert is first unscrewed from the molded elevator, subjecting the molded threads of the elevator to damage caused by the friction of this unthreading. In addition, due to the complexity of this mold, the mold itself is expensive.

During assembly of the deodorant applicator 2, the screw 6 is typically rotated at high speeds into the receptacle 12 until the screw 6 bottoms out in the receptacle 12. The high speeds of this coupling process subjects the screw 6 and the threads 14 of the receptacle 12 to heat caused by friction, thus subjecting the screw 6 and the threads 14 of the receptacle 12 to damage caused by the heat, such as melting and/or deformation. In order to combat this damage, the speed of assembling the screw 6 and receptacle 12 is typically restricted in order to reduce the heat experienced by the screw 6 and the receptacle 12. However, limiting the speed reduces the number of applicators 2 produced per minute, thus reducing productivity and increasing costs, and fails to entirely eliminate the heat experienced by the screw 6 and the receptacle 12. Whether the screw 6 and the elevator 6 are coupled at high or low speeds, this coupling process is time consuming. Additionally, the receptacle 12 is typically formed from a different material than the screw 6 in order to further limit the potential damage caused by friction. However, due to this mix of materials, the deodorant applicator 2 cannot be recycled. While a deodorant applicator is described herein, it is to be understood that the applicator can be used to dispense any suitable type of toiletry or cosmetic.

SUMMARY OF THE INVENTION

A deodorant applicator includes a housing, a screw with a threaded shaft, and an elevator assembly. The elevator assembly includes a receptacle and a threaded portion formed by a plurality of segments or ratchet discs. The ratchet discs can each be slid or pushed onto the screw to form a stack. The receptacle is slid over the stack of ratchet discs so that the stack of ratchet discs forms a threaded portion of the elevator assembly.

In one embodiment, a toiletry applicator is described. The toiletry applicator includes a housing and a screw including a screw shaft and a screw knob coupled to the screw shaft. An elevator assembly is received at a base of the screw shaft and includes a receptacle configured to retain a toiletry and having a thread path. The elevator assembly also includes a plurality of ratchet discs stacked together to form a ratchet disc assembly defining the thread path. Each ratchet disc includes a plurality of thread portions that form a section of the thread path.

In another embodiment, a ratchet disc assembly for a toiletry applicator is described. The ratchet disc assembly includes a plurality of ratchet discs stacked together to form the ratchet disc assembly having an interior rising thread path. Each ratchet disc includes a base and a plurality of thread portions rising from the base to form a truncated pyramid shape. Each of the plurality of thread portions is separated from each other by a gap. The inner surface of each thread portion is threaded to form a section of the rising thread path.

In yet another embodiment, a method of forming a toiletry applicator is described. The toiletry applicator includes a housing, a screw received in the housing and including a screw knob, a screw shaft coupled to the screw knob, and a platform at a base of the screw shaft adjacent to the screw knob. The toiletry applicator also includes a receptacle including a thread recess and a ratchet disc assembly forming a thread path retained in the thread recess. The method includes sliding a first of a plurality of ratchet discs along a length of the screw shaft to rest on the platform. The method also includes sliding each of the remaining ratchet discs of the plurality of ratchet discs along the screw shaft to rest on a preceding ratchet disc and form the ratchet disc assembly. The method further includes positioning the elevator on the screw shaft such that the ratchet disc assembly is received in the thread recess of the receptacle.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. The drawings are not necessarily to scale, emphasis generally being placed upon illustrating the features of certain embodiments of the invention. Thus, for further understanding of the nature and objects of the invention, references can be made to the following detailed description, read in connection with the drawings in which.

DETAILED DESCRIPTION OF THE INVENTION

Figure 1:
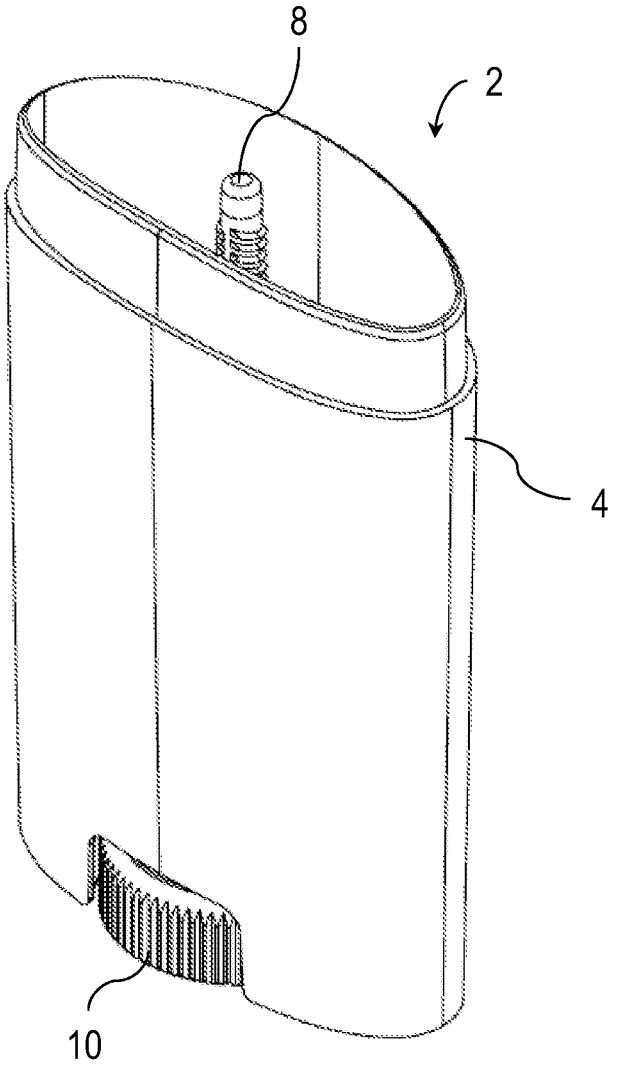
FIG. 1 PRIOR ART
FIG. 1 is an isometric view of an embodiment of a prior art deodorant applicator.
Figure 2:
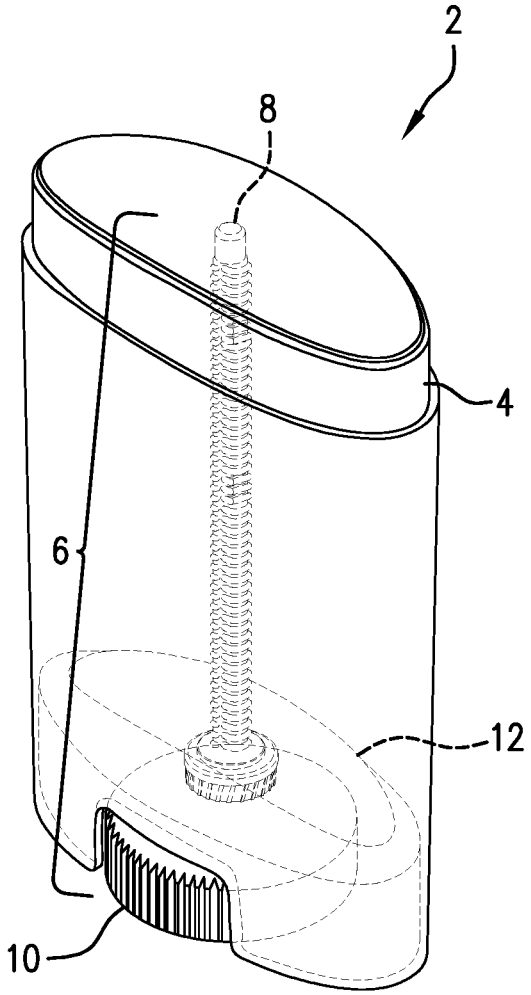
FIG. 2 is a transparent isometric view of an embodiment of a prior art deodorant applicator.
Figure 3A:
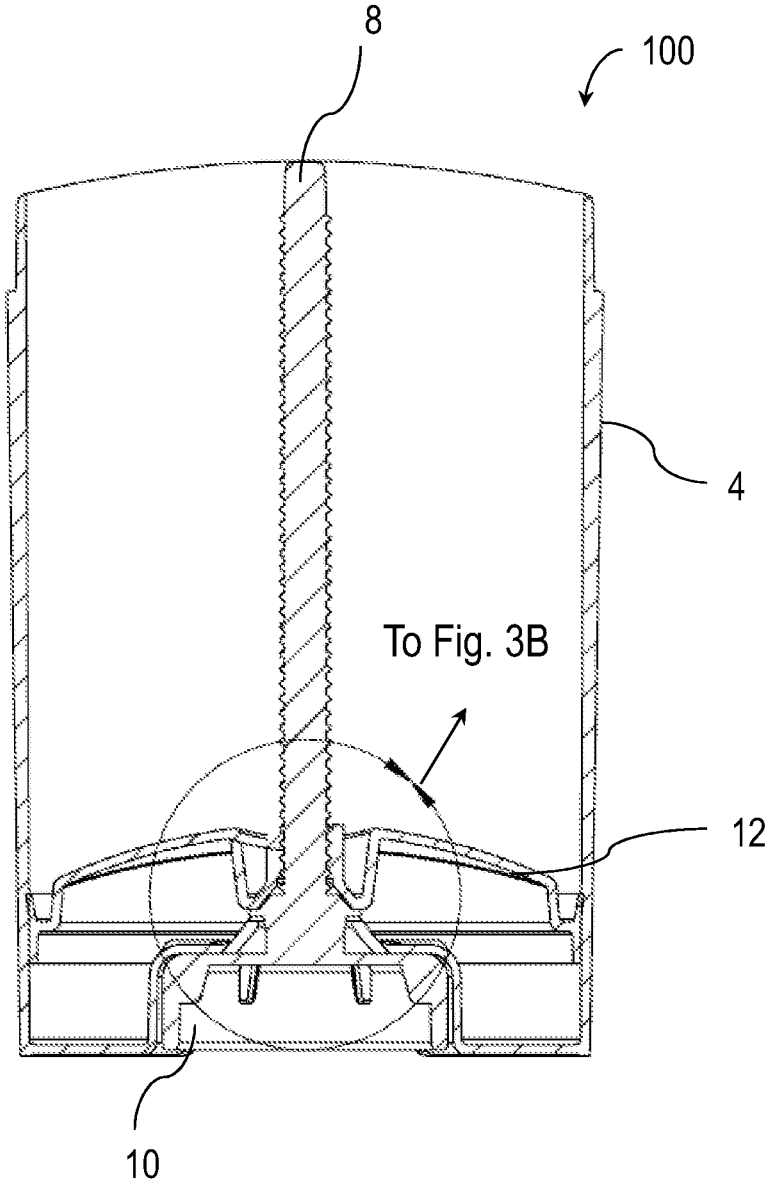
FIG. 3A PRIOR ART
FIG. 3A is a cut-away view of a prior art deodorant applicator.
Figure 3B:
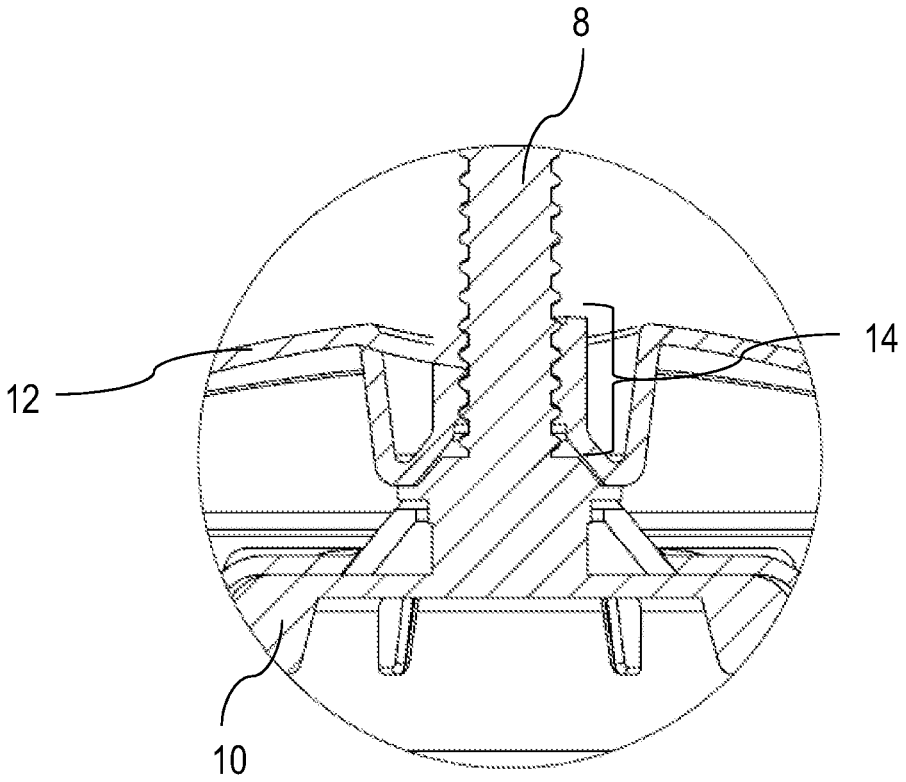
FIG. 3B PRIOR ART
FIG. 3B is an enlarged view of a section of the deodorant applicator of FIG. 3A.
Figure 4A:
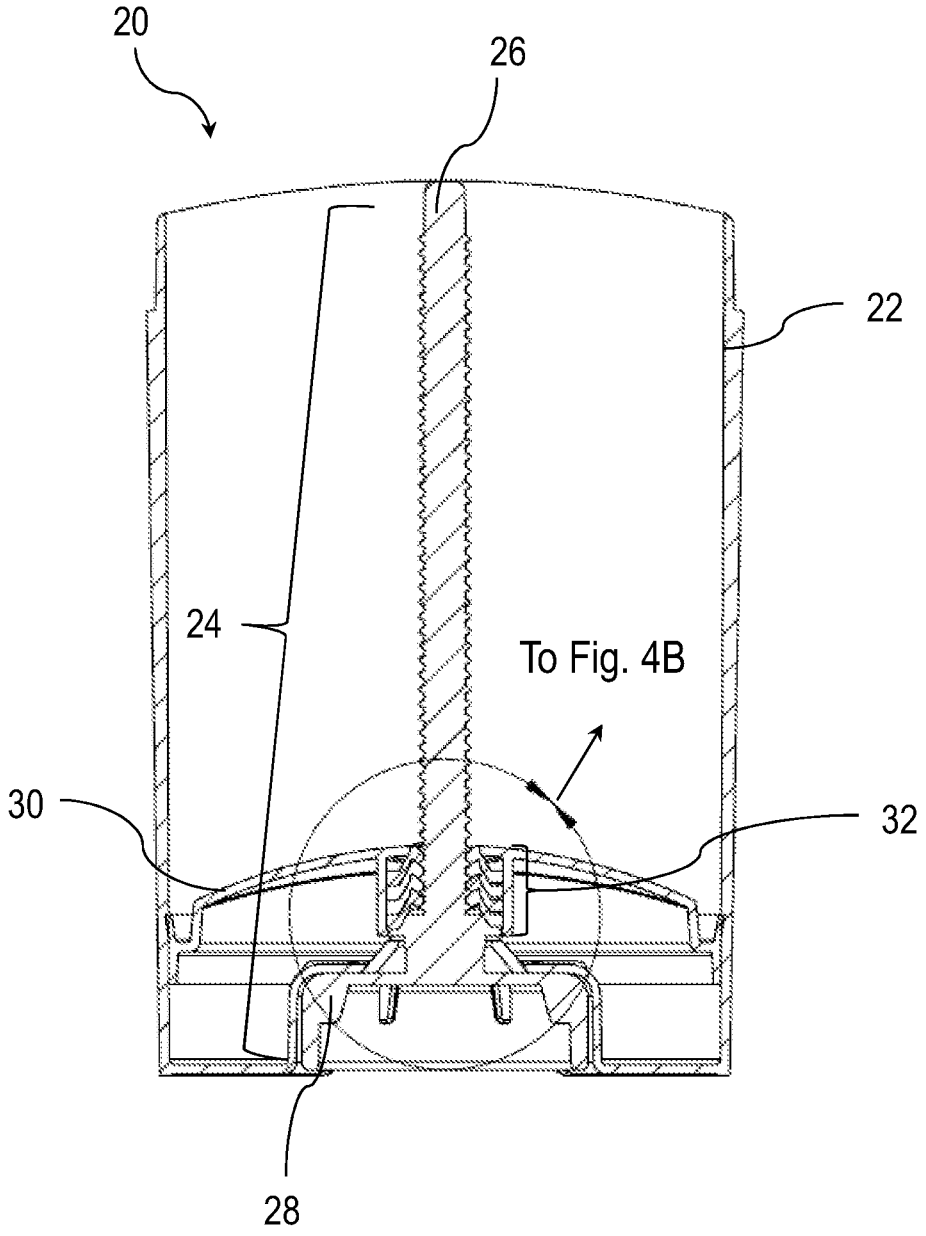
FIG. 4A is a cut-away view of an embodiment of a deodorant applicator.
Figure 4B:
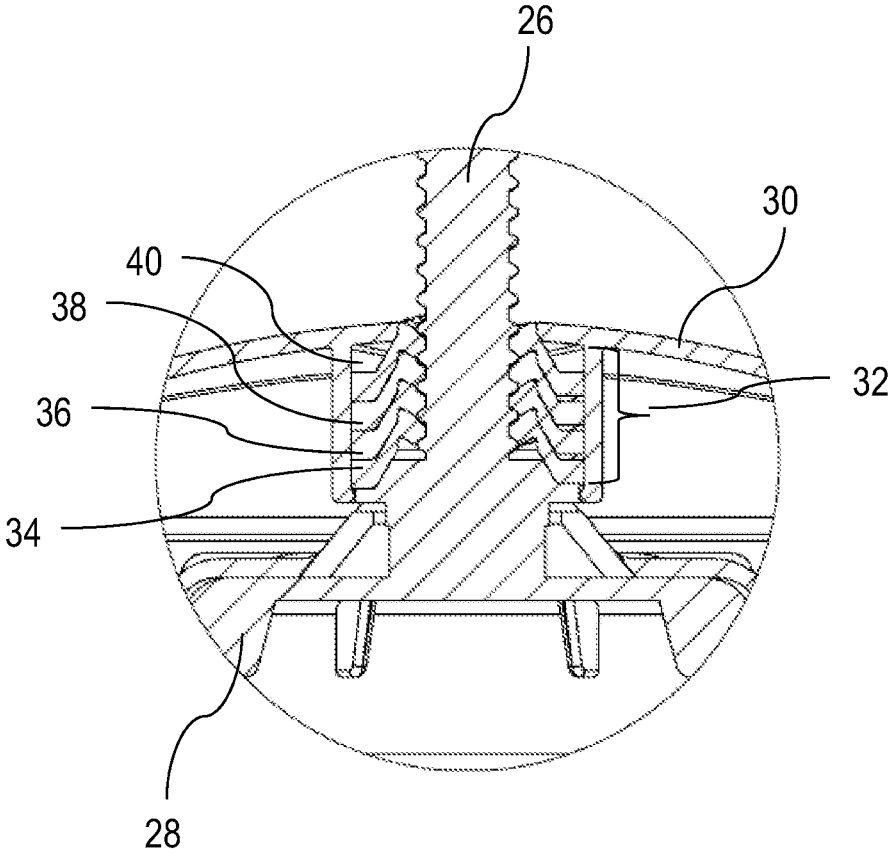
FIG. 4B is an enlarged view of a section of the deodorant applicator of FIG. 4A.

FIGS. 4A-4B are cut-away views of an embodiment of a deodorant applicator 20. The deodorant applicator 20 includes a housing 22, a screw 24, which has a screw shaft 26 and a screw knob 28, and an elevator or toiletry receptacle 30. Similar to the deodorant applicator 2 illustrated by FIGS. 1-3B, the screw 24 is inserted through the receptacle 30 so that rotation of the screw 24 raises the receptacle 30 within the housing 22, dispensing the deodorant (not shown). During assembly, the receptacle 30 is moved into position at the bottom of the screw shaft 26 so that following assembly, the receptacle 30 is positioned at the base 44 (FIG. 5A) of the screw shaft 26, adjacent to the screw knob 28.

As discussed above, typical deodorant applicators 2 include an receptacle 12 that has an integral threaded section 14, as illustrated in FIG. 3B. By contrast, the receptacle 30 of the deodorant applicator 20, as described below, has a threaded section that is formed of a multi-part ratchet disc assembly 32 (FIGS. 4A-4B).

Figure 5A:
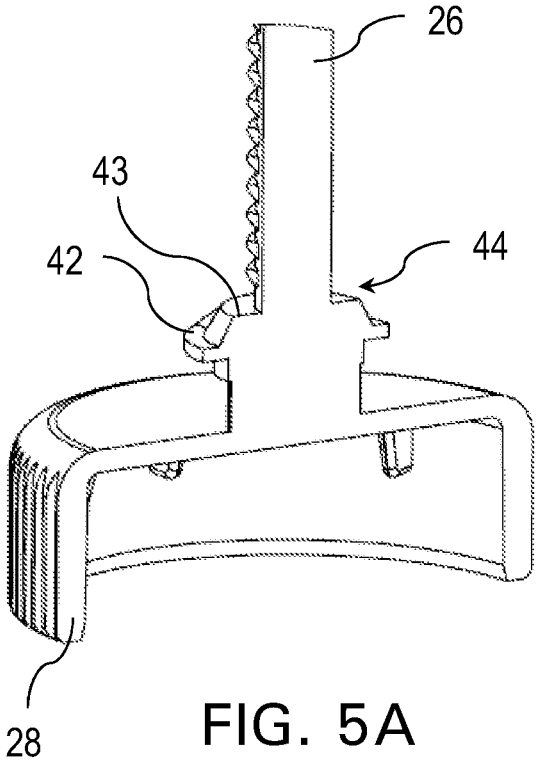
FIGS. 5A-5G are cut-away isometric views of assembly of a section of the deodorant applicator of FIG. 4A.
Figure 5B:
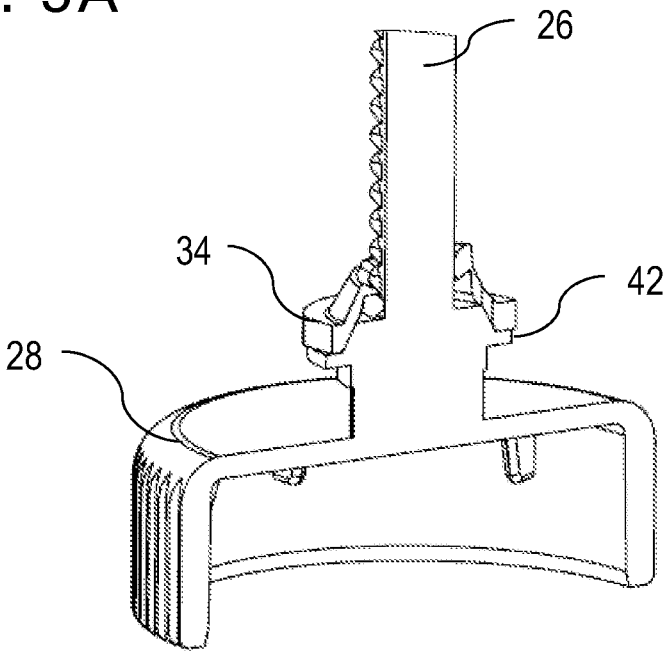
Figure 5C:
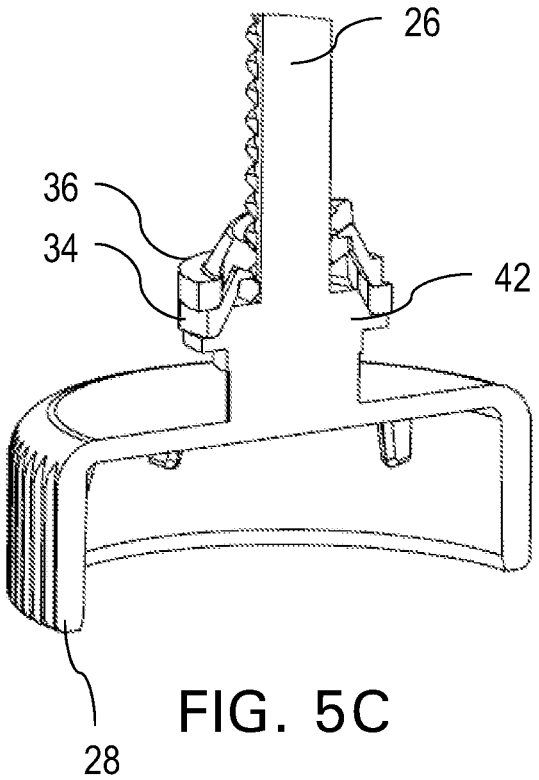
Figure 5D:
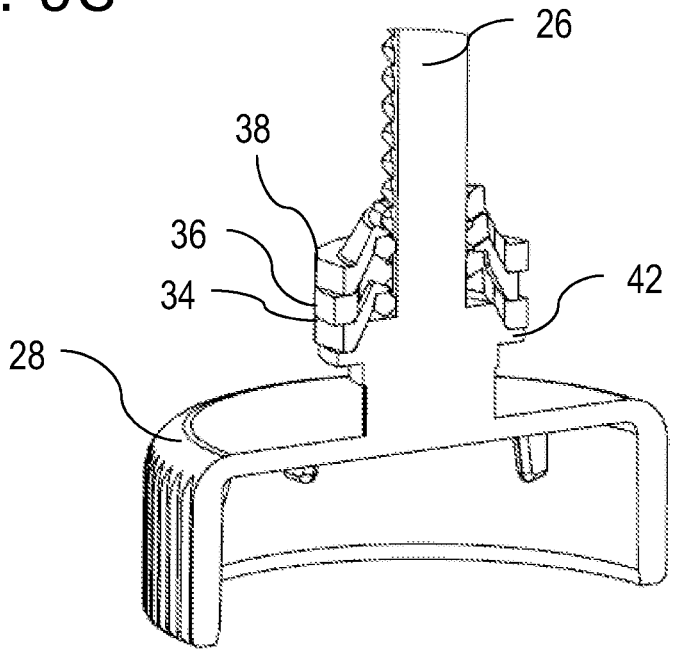
Figure 5E:
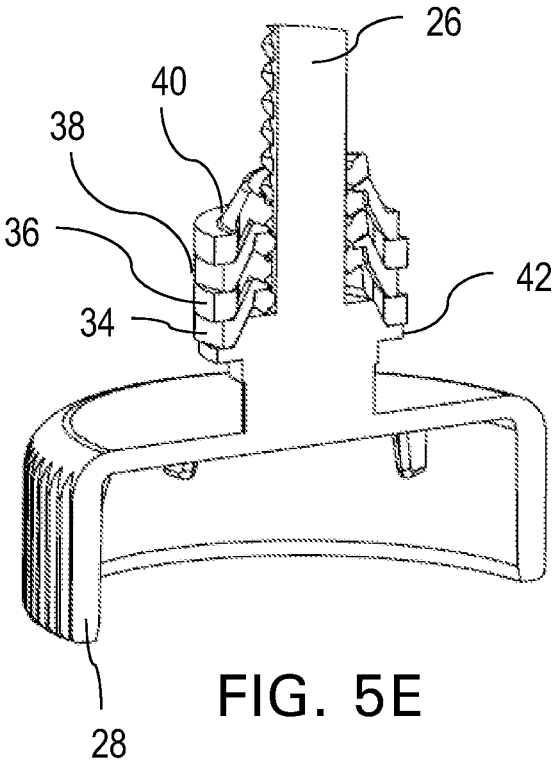
Figure 8A:
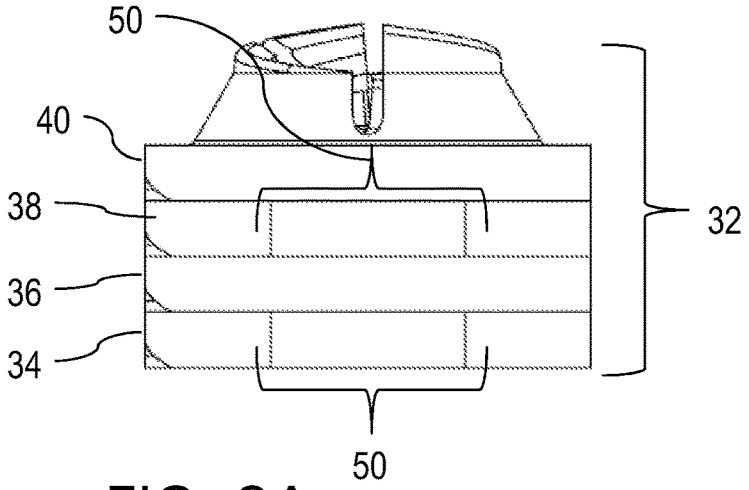
FIGS. 8A-8B are side views of an embodiment of an assembly of ratchet discs.

As illustrated by FIGS. 5A-6C, the ratchet disc assembly 32 includes a plurality of ratchet discs 34, 36, 38, 40 stacked together to form the ratchet disc assembly 32 (FIG. 8A). Referring to FIG. 5A, in this embodiment, a platform 42 is positioned at the base 44 of the screw shaft 26. The screw knob 28 is received or positioned within a screw knob recess 48 of the housing 22 (FIG. 5F). During assembly of the deodorant applicator 20, each of the plurality of ratchet discs 34, 36, 38, 20 is sequentially positioned on the platform 42 of the screw 24, as illustrated in FIGS. 5B-5E. For example, each ratchet disc 34, 36, 38, 40 can be sequentially slid or pushed down the length of the screw shaft 26 until the ratchet disc comes to rest on the platform 42 or the ratchet disc positioned on the shaft immediately before each ratchet disc. While the ratchet disc assembly 32 illustrated herein includes four ratchet discs 34, 36, 38, 40, it is to be understood that the ratchet disc assembly 32 can include any suitable number of ratchet discs.

Figure 5F:
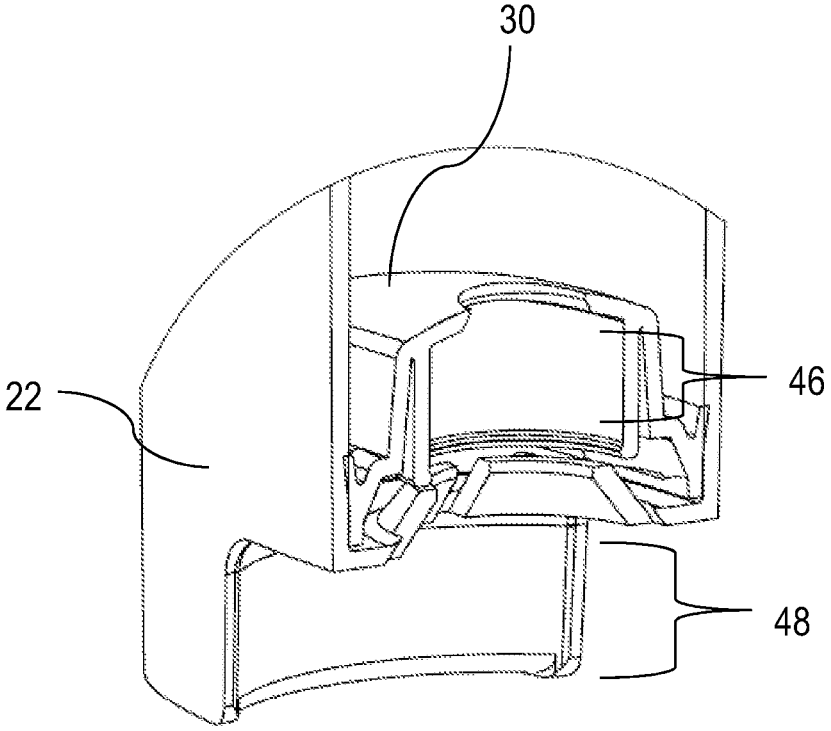
Figure 5G:
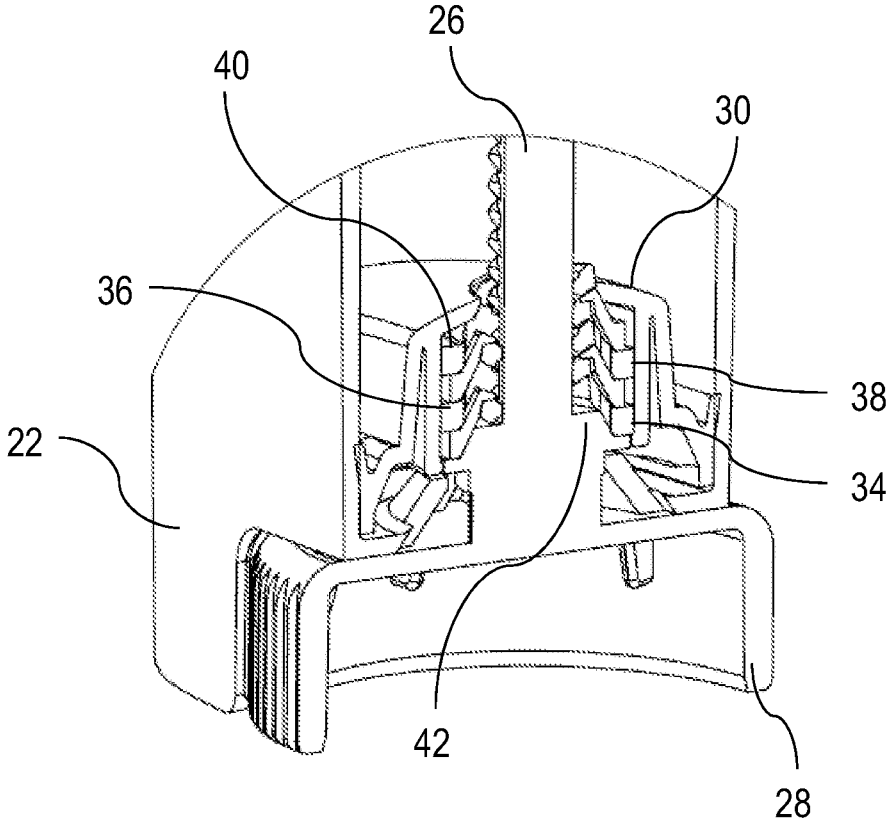
Figure 6A:
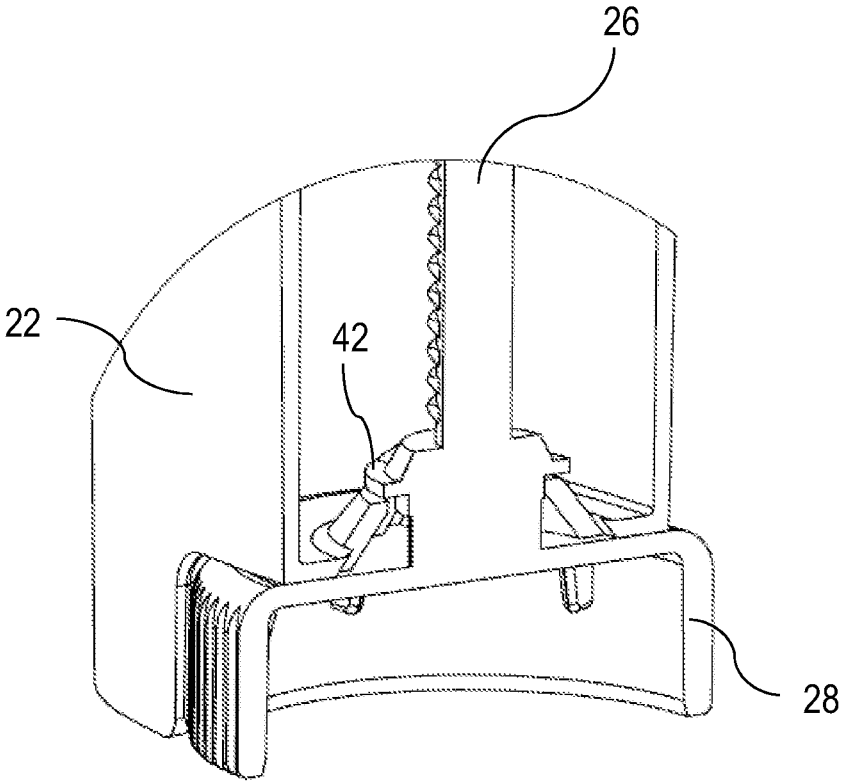
FIGS. 6A-6C are cut-away isometric views of assembly of a section of the deodorant applicator of FIG. 4A.
Figure 6B:
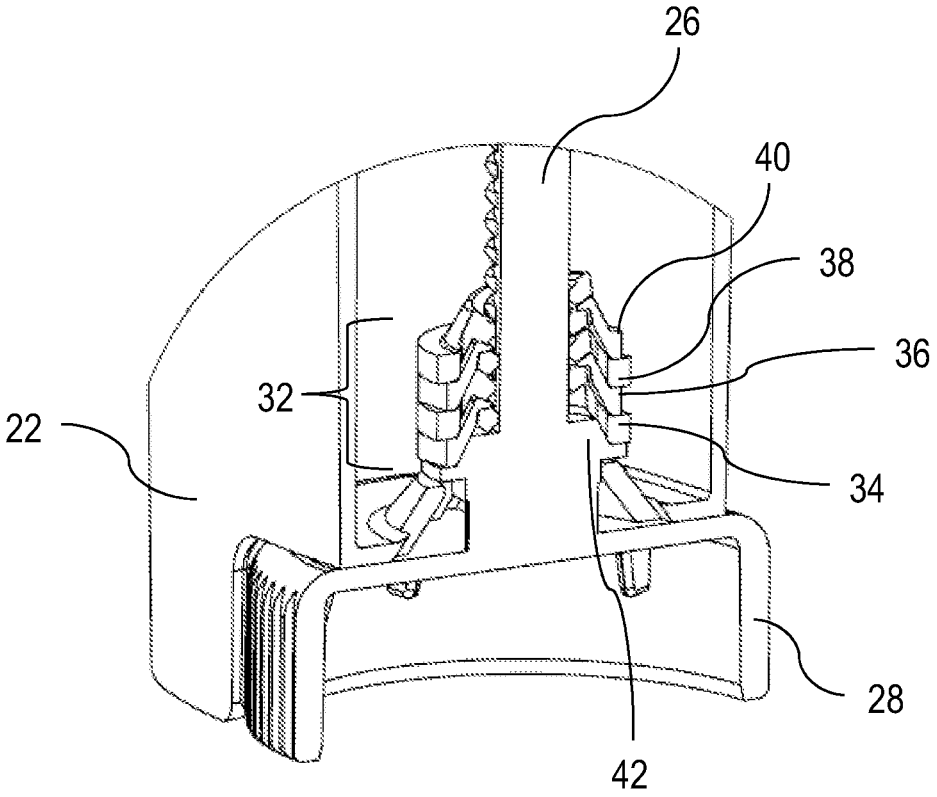
Figure 6C:
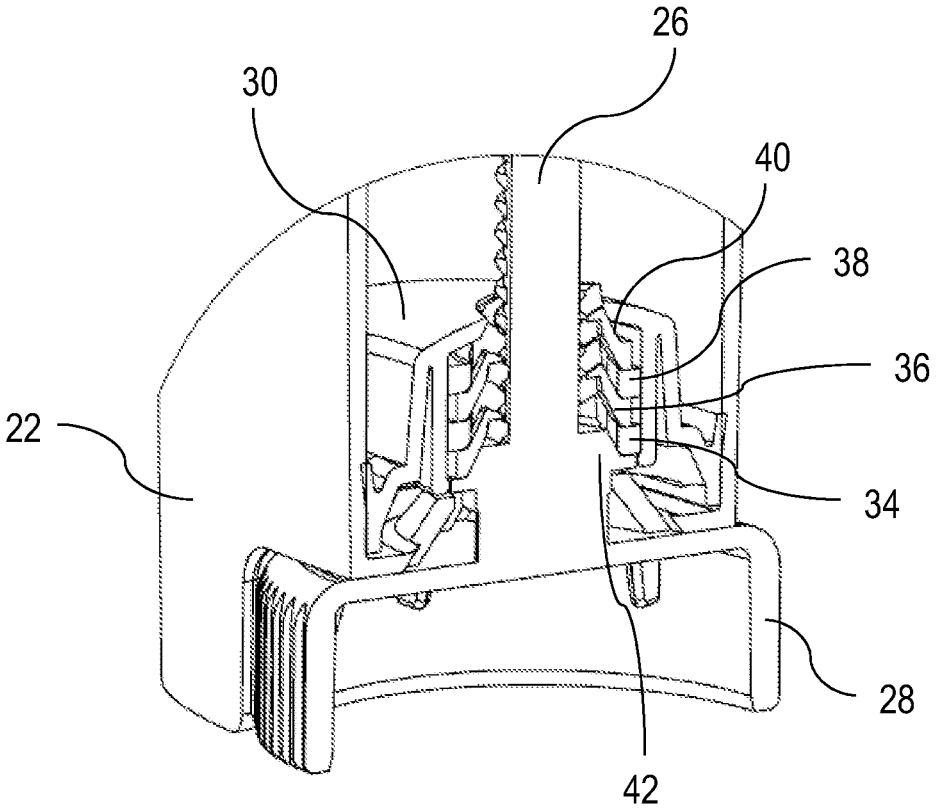

The receptacle 30 is formed to include a thread recess 46, as illustrated in FIG. 5F. As illustrated in FIG. 5G, when all of the ratchet discs 34, 36, 38, 40 of the ratchet disc assembly 32 have been mounted on the screw shaft 26, the receptacle 30 is positioned on the screw shaft 26 over the ratchet disc assembly 32 so that the ratchet disc assembly 32 is positioned within the thread recess 46. The ratchet disc assembly 32 locks into position within the thread recess 46 of the receptacle 30 so that the ratchet disc assembly 32 and the receptacle 30 together form an elevator assembly and the ratchet disc assembly 32 moves with the receptacle 30. FIGS. 6A-6C illustrate this assembly process including the housing 22.

Figure 7A:
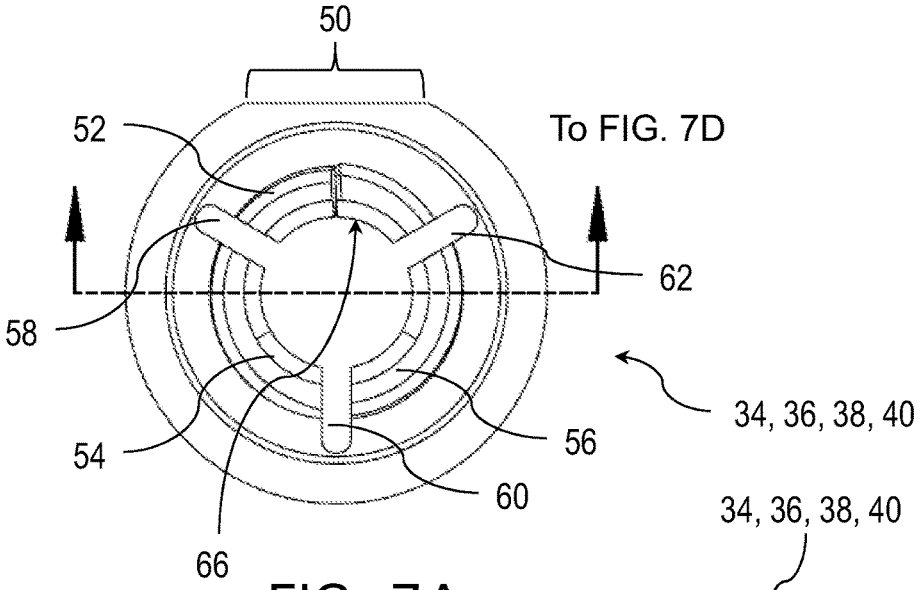
FIG. 7A is a top view of an embodiment of a ratchet disc.
Figure 7B:
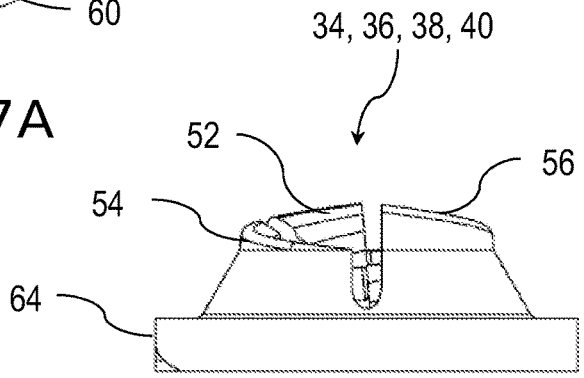
FIGS. 7B-7C are side views of the embodiment of the ratchet disc of FIG. 7A.
Figure 7C:
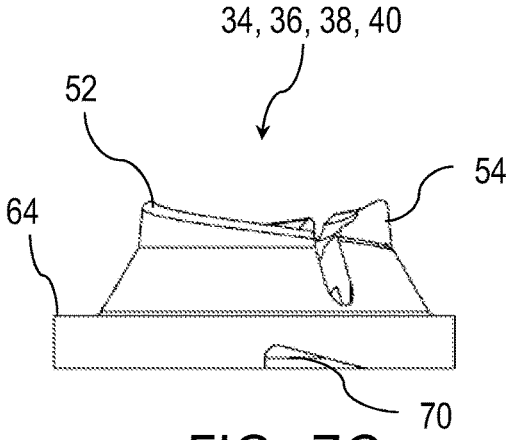
Figure 7D:
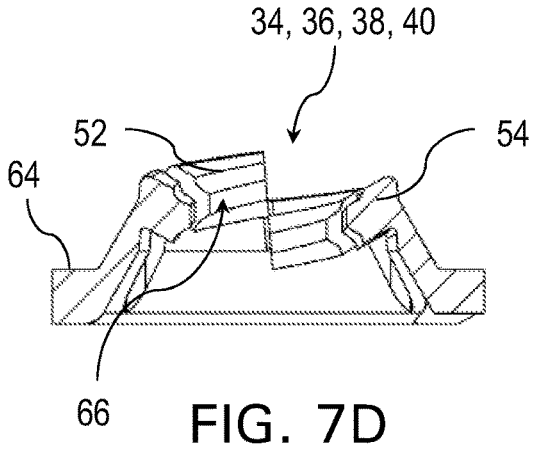
FIG. 7D is a cut-away view of the ratchet disc of FIG. 7A.
Figure 7E:
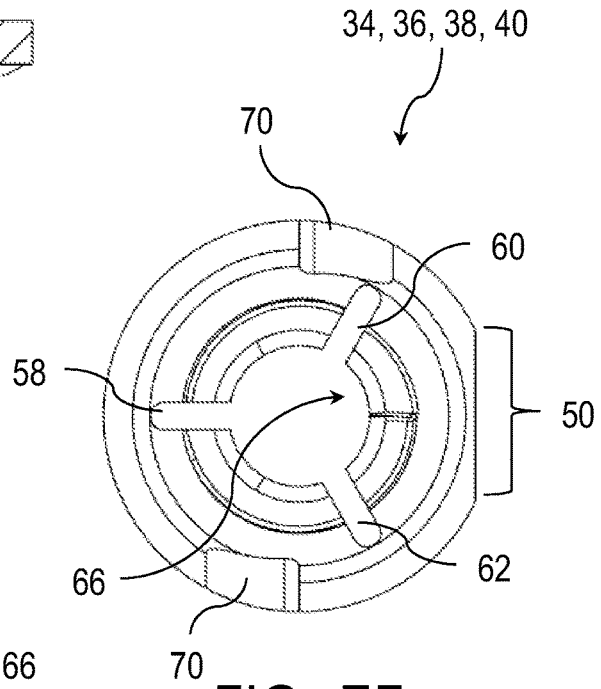
FIG. 7E is a bottom view of the ratchet disc of FIG. 7A.
Figure 7F:
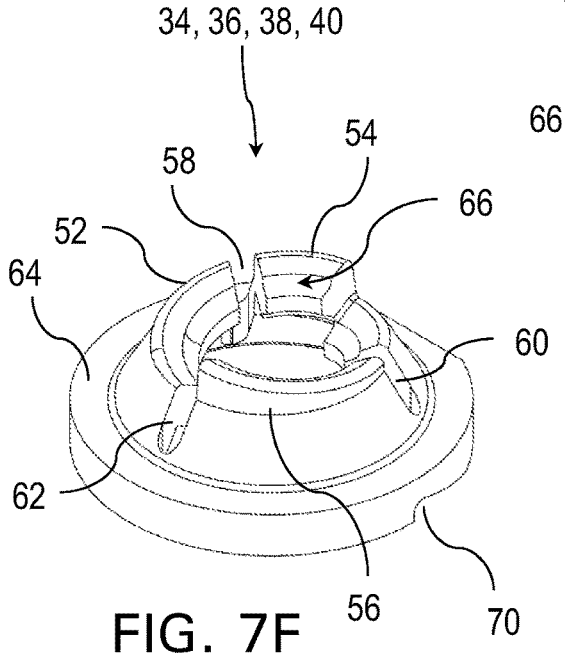
FIG. 7F is an isometric view of the ratchet disc of FIG. 7A.

Referring now to FIGS. 7A-7F, the ratchet discs will now be further described. In an embodiment, each ratchet disc 34, 36, 38, 40 has an identical shape. Because of this identical shape, all of the ratchet discs 34, 36, 38, 40 can be formed using a single mold, thus simplifying the fabrication process and reducing costs. In addition, the mold can be simplified as a threaded insert is no longer required, nor is a threaded insert required to be removed following the formation process. Thus, the thread portions are not subject to heat damage cause by friction during the formation and assembly process. As illustrated by FIG. 7A, in this embodiment, the circumference of each of the ratchet discs 34, 36, 38, 40 is a circular shape, with one flattened section. This flattened section is an orientation indicator 50 used when assembling the ratchet disc assembly 32.

Figure 8C:
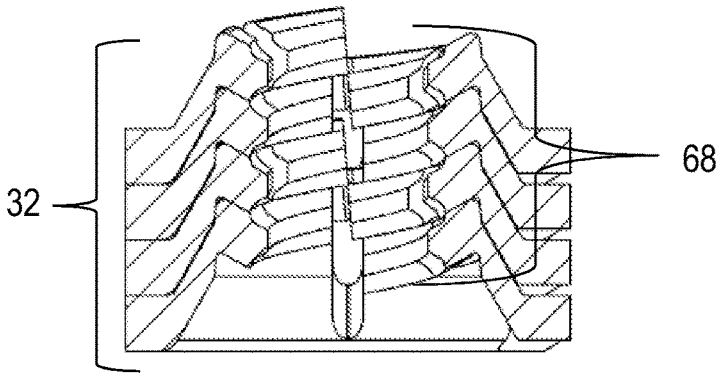
FIG. 8C is a cut-away view of the assembly of ratchet discs of FIG. 8A.
Figure 8D:
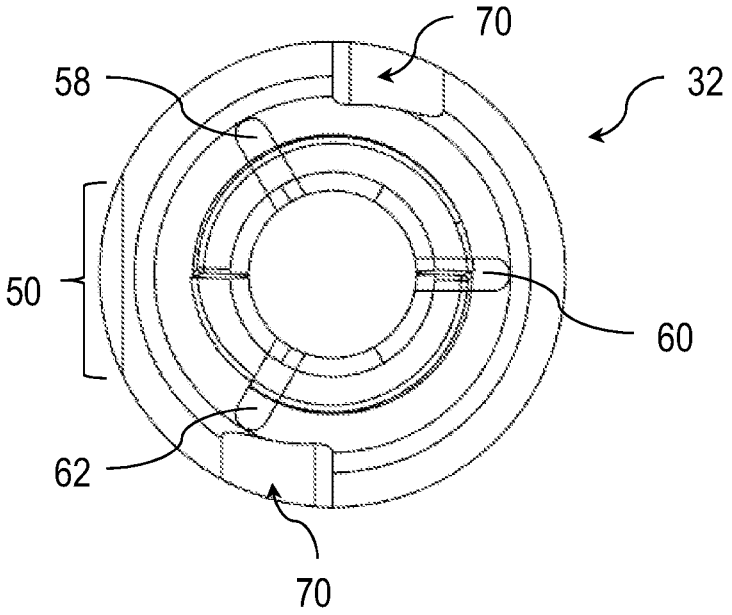
FIG. 8D is a bottom view of the assembly of ratchet discs of FIG. 8A.
Figure 9:
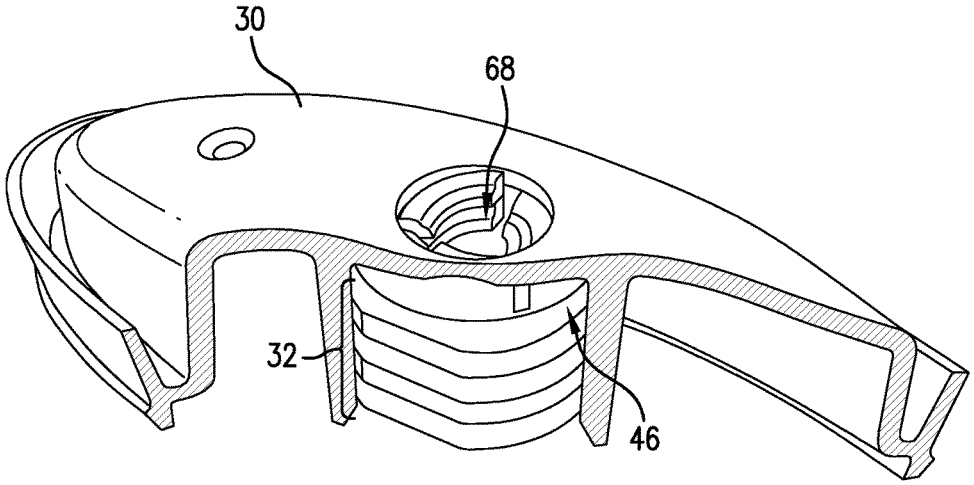
FIG. 9 is an isometric view of an embodiment of an assembled elevator.
Figure 10:
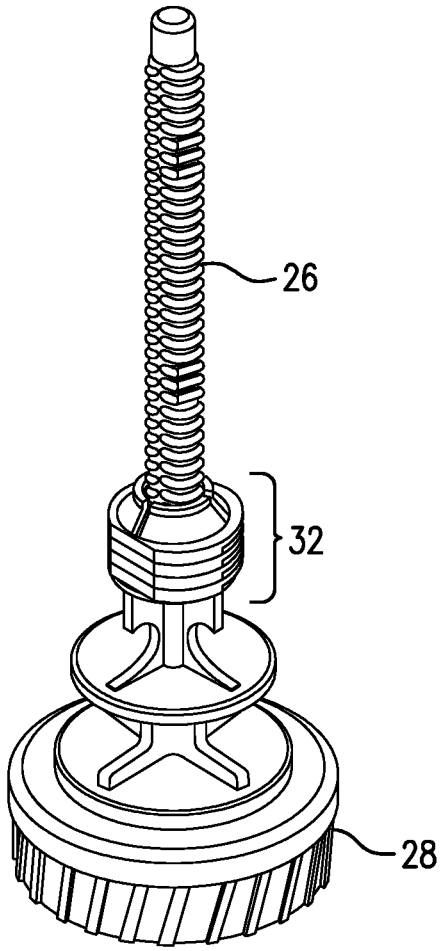
FIG. 10 is an isometric view of an embodiment of a screw and ratchet disc assembly.
Figure 11:
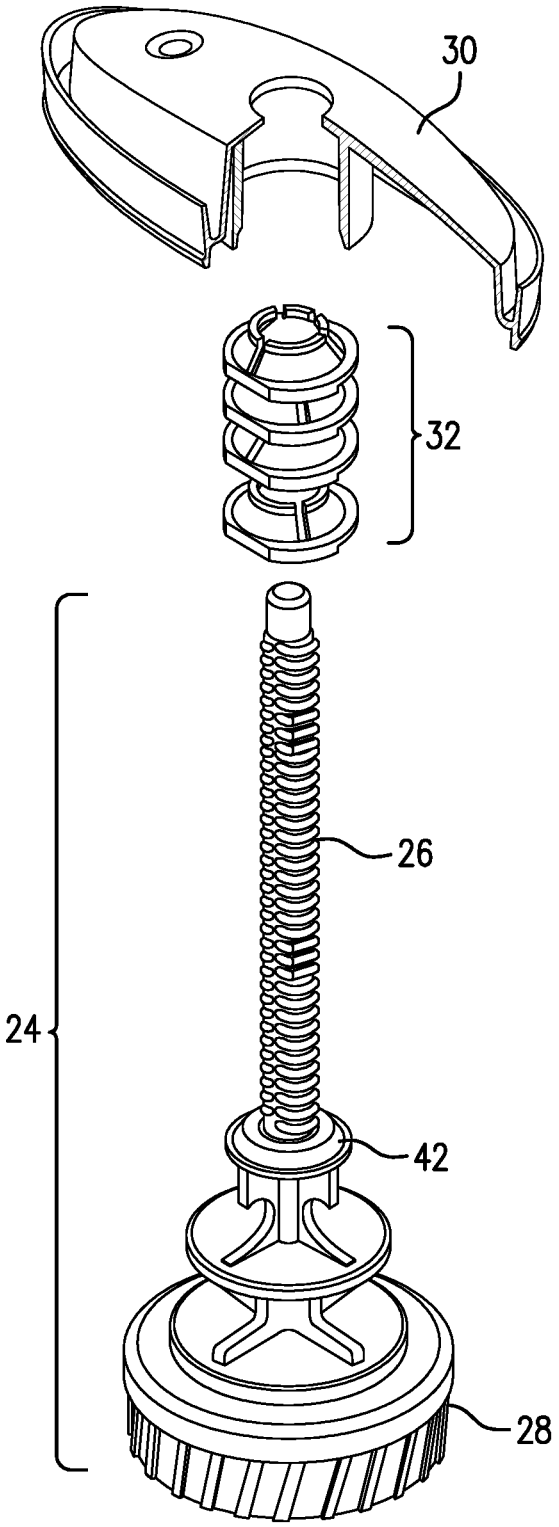
FIG. 11 is an exploded isometric view of a screw and elevator assembly.
Figure 12:
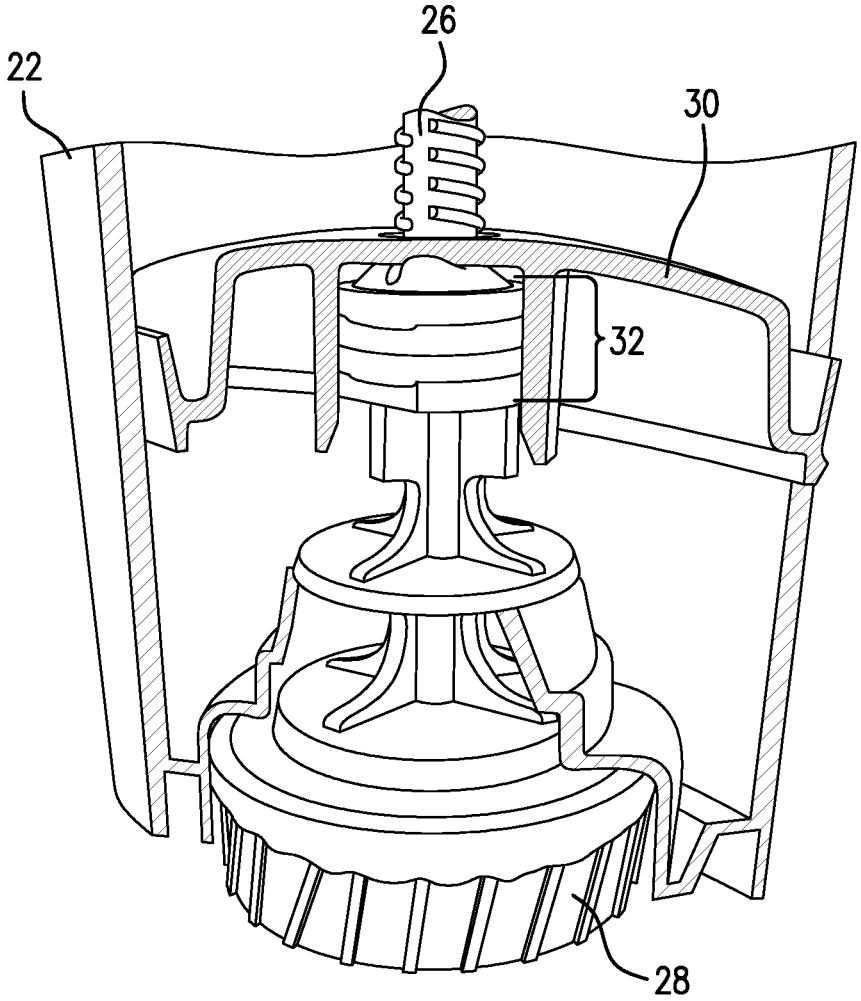
FIG. 12 is a partial cut-away illustrative view of an assembled deodorant applicator.
Figure 13:
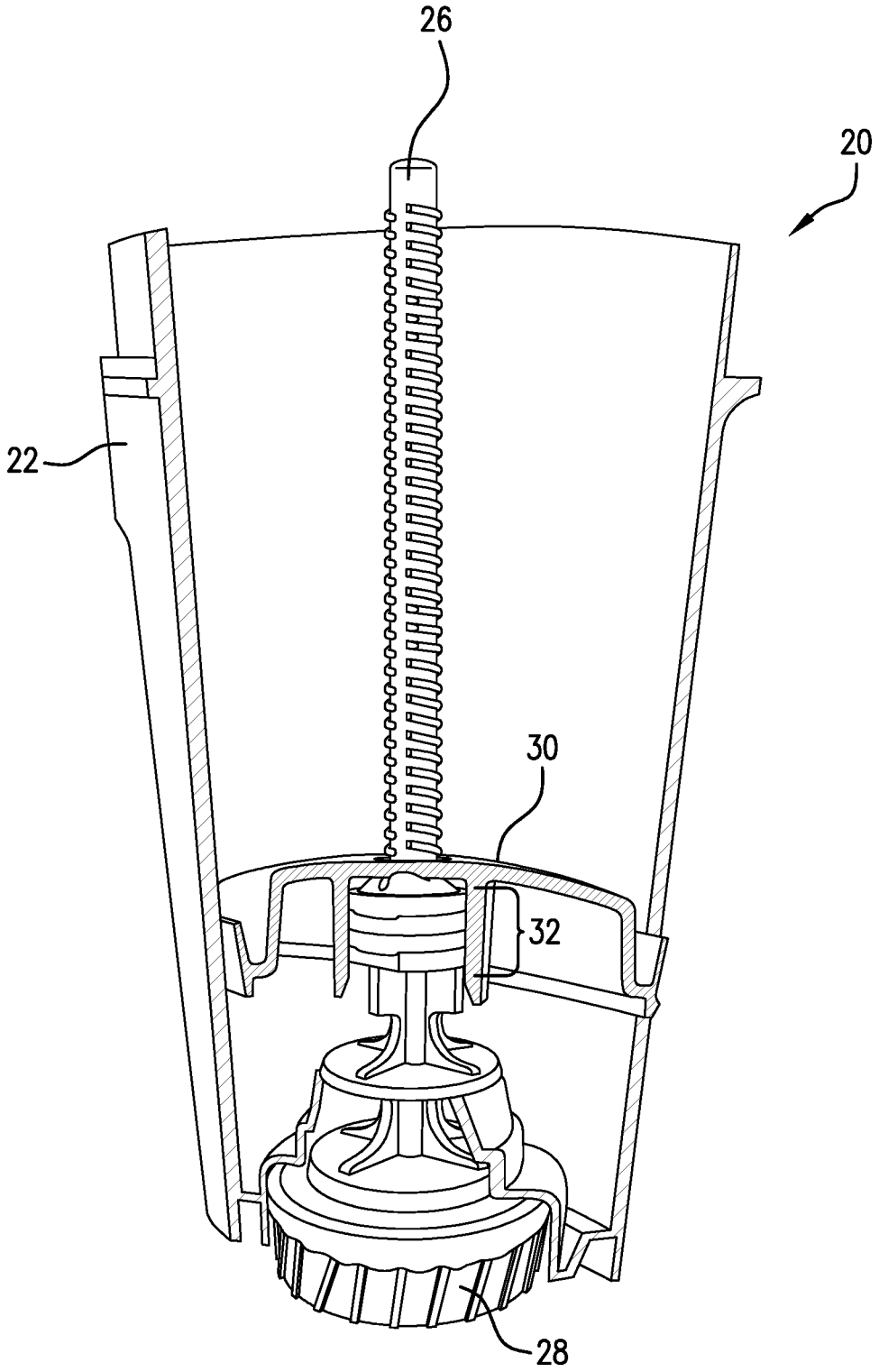
FIG. 13 is a cut-away illustrative view of an assembled deodorant applicator.

In this embodiment, each ratchet disc 34, 36, 38, 40 has a plurality of thread portions 52, 54, 56 rising from a base 64, giving the ratchet disc 34, 36, 38, 40 a generally truncated cone shape. The inner surface 66 of each thread portion 52, 54, 56 is threaded (FIG. 7D) so that together, the thread portions 52, 54, 56 form a section or part of the rising thread 68 of the receptacle 30 (FIG. 8C, 9). Each thread portion 52, 54, 56 is separated from the adjacent thread portions 52, 54, 56 by a gap or slot 58, 60, 62. By separating the thread portions 52, 54, 56 by the gaps 58, 60, 62, the thread portions 52, 54, 56 are able to flex around the screw shaft 26 during assembly. This flexing enables each ratchet disc 34, 36, 38, 40 to be slid or pushed down the length of the screw shaft 26 rather than having to be rotated around or screwed onto the screw shaft. In an embodiment, the platform 42 of the screw 24 can include at least one rib 43. In this embodiment, the base 64 of each ratchet disc 34, 36, 38, 40 also includes at least one cut-out or recess 70 that interlocks with this rib 43 to prevent the first ratchet disc 34 from rotating on or relative to the platform 42.

The threads of the screw shaft 26 can have any suitable helical form or number of leads. For example, the screw 24 can be a one (1) lead or single-start in which a single helix, lead, or ridge wraps around the screw shaft 26 and, during rotation of the screw 24, a lead or helix forms every 360 degrees. In this example, during rotation of the screw 24, the receptacle 30 advances the width of a single ridge/helix per 360 degree rotation of the screw 24. In another example, the screw 24 can be a two (2) lead or double-start in which two helices, leads, or ridges wrap around the screw shaft 26 and, during rotation of the screw 24, a new lead or helix forms every 180 degrees. In this example, the receptacle 30 advances the width of two ridges/helices per 360 degree rotation of the screw 24. In another example, the screw 24 can be a three (3) lead or triple-start in which three helices/leads/ridges wrap around the screw shaft 26 and, during rotation of the screw 24, a new helix/lead is formed every 120 degrees. In this example, the receptacle 30 advances the width of three ridges/helices per 360 degree rotation of the screw 24.

Referring to FIGS. 8A-8F, the thread portions 52, 54, 56 can be formed to interact with the helical form/number of leads of the screw 24. For example, the thread portions 52, 54, 56 can be 120 degree segments. In addition, as illustrated by FIGS. 8A-8F, the ratchet discs 34, 36, 38, 40 can be oriented to provide a continuous elevator thread path 68 that matches the lead of the screw 24. The orientation indicator 50 of each ratchet disc 34, 36, 38, 40 is positioned relative to the orientation indicator 50 of the preceding ratchet disc 34, 36, 38, 40 in the ratchet disc assembly 32 to facilitate the creation of the correct lead elevator thread path 68.

Figure 8B:
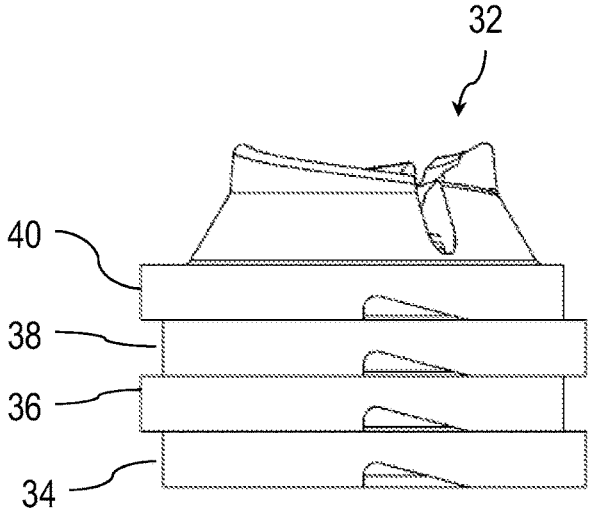
Figure 8E:
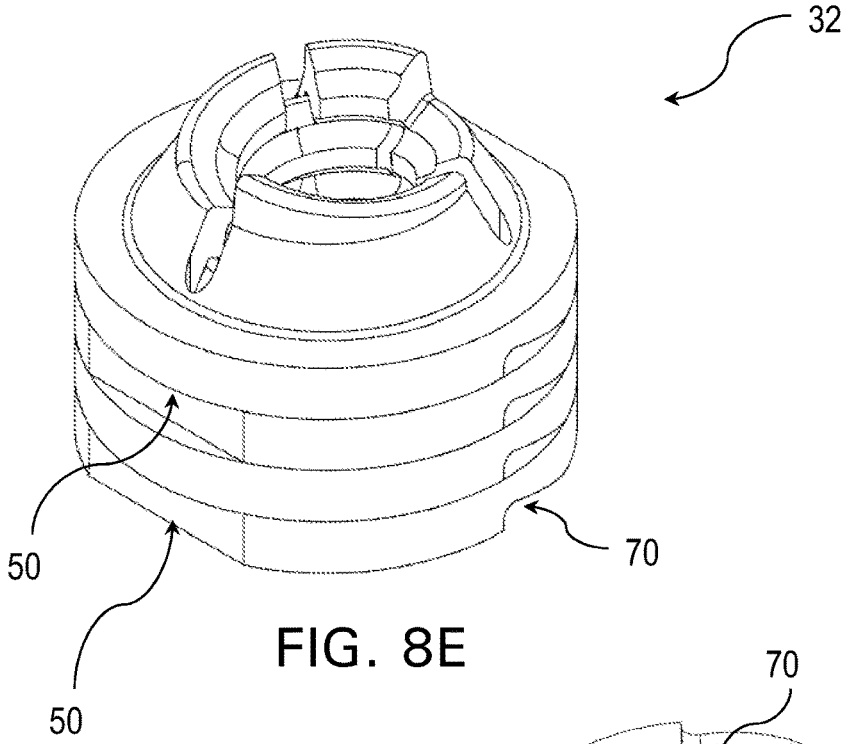
FIG. 8E is a top isometric view of the assembly of ratchet discs of FIG. 8A.
Figure 8F:
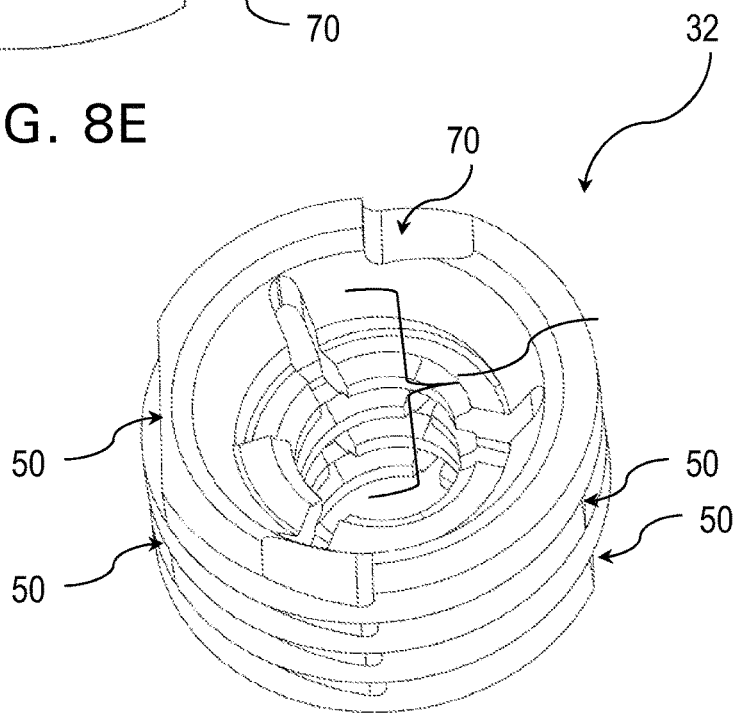
FIG. 8F is an bottom isometric view of the assembly of ratchet discs of FIG. 8A.

For example, for a two-lead screw 24, the orientation indicator 50 of each ratchet disc 34, 36, 38, 40 is off-set or rotated 180 degrees relative to the orientation indicator 50 of the preceding disc 36, 38, 40, as illustrated in FIGS. 8B, 8E, 8F, to form a continuous two-lead thread path (helix forming every 180 degrees). In another example, a three-lead thread path can be formed by off-setting or rotating successive orientation indicators 50 120 degrees to form a three-lead thread path. In addition to creating a thread path 68 corresponding to the lead of the screw 24, this asymmetrical or off-set positioning of the ratchet discs 34, 36, 38, 40 prevents the gaps 58, 60, 62 of each ratchet disc 34, 36, 38, 40 from lining up with the gaps 58, 60, 62 of the adjacent ratchet disc(s) 34, 36, 38, 40. This asymmetrical or off-set orientation of the gaps 58, 60, 62 prevents liquids from the deodorant from leaking through the gaps 58, 60, 62 and out of the deodorant applicator 20, thus sealing the deodorant applicator 20.

Assembly of the deodorant applicator 20 is further illustrated in FIGS. 9-13. The ratchet disc assembly 32 is received in and locked into the thread recess 46 of the receptacle 30. The threaded surface of the thread portions 52, 54, 56 form the thread path 68 of the receptacle 30. The ratchet disc assembly 32 is positioned on the platform 42 at the base 44 of the screw shaft 26.

While the present invention has been particularly shown and described with reference to certain exemplary embodiments, it will be understood by one skilled in the art that various changes in detail may be effected therein without departing from the spirit and scope of the invention that can be supported by the written description and drawings. Further, where exemplary embodiments are described with reference to a certain number of elements it will be understood that the exemplary embodiments can be practiced utilizing either less than or more than the certain number of elements.

The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A toiletry applicator comprising:
- a housing;
- a screw comprising a screw shaft and a screw knob coupled to the screw shaft; and
- an elevator assembly received at a base of the screw shaft and comprising:
  - a receptacle configured to retain a toiletry, the receptacle having a thread path; and
  - a plurality of discs stacked together to form a disc assembly defining the thread path, each disc comprising a plurality of thread portions that form a section of the thread path.

2. The toiletry applicator of claim 1, wherein the receptacle comprises a thread recess and wherein the disc assembly is retained in the thread recess.

3. The toiletry applicator of claim 1, wherein the plurality of thread portions of each disc are separated by one or more slots.

4. The toiletry applicator of claim 3, wherein the one or more slots are configured to allow each disc to flex in order to be pushed onto the screw shaft during installation.

5. The toiletry applicator of claim 4, wherein the plurality of discs may be rotated in order to be unscrewed from the screw shaft.

6. The toiletry applicator of claim 1, wherein each disc comprises a circular base from which the plurality of thread portions rises and wherein the circular base comprises a linear section comprising an orientation indicator.

7. The toiletry applicator of claim 1, wherein the screw shaft has a lead comprising one of a single lead, a double lead, or a triple lead and wherein the plurality of discs are oriented such that the thread path corresponds to the lead of the screw shaft.

8. The toiletry applicator of claim 7, wherein each disc of the disc assembly is off-set 180 degrees relative to a preceding disc to form a double lead thread path.

9. The toiletry applicator of claim 7, wherein each disc of the disc assembly is off-set 120 degrees relative to a preceding disc to form a triple lead thread path.

10. The toiletry applicator of claim 1, wherein the screw further comprises a platform positioned at the base of the screw shaft and on which the disc assembly rests when the receptacle is positioned at the base of the screw shaft.

11. The toiletry applicator of claim 1, wherein the disc assembly and the receptacle interlock to form the elevator assembly.

12. The toiletry applicator of claim 1, wherein the toiletry applicator comprises a deodorant applicator.

13. A dispensing device comprising:
- a housing;
- a screw comprising a screw shaft and a screw knob coupled to the screw shaft;
- an elevator assembly received at a base of the screw shaft and comprising,
  - a receptacle configured to retain a toiletry, the receptacle defining a thread path configured to engage the screw shaft, and a plurality of discs stacked together to form a disc assembly defining the thread path configured to engage the screw shaft.

14. The dispenser device of claim 13, wherein the disc assembly is configured to move along the screw shaft.

15. The dispenser device of claim 13, wherein each disc further comprises a plurality of thread portions that are separated by a plurality of slots such that each threaded portion extends along an arc that is less than 360°.

16. The dispenser device of claim 15, wherein each disc comprises a circular base from which the plurality of thread portions rises and wherein the circular base comprises a linear section comprising an orientation indicator.

17. The dispenser device of claim 15, wherein the plurality of slots are configured to allow each disc to flex in order to be pushed onto the screw shaft during installation.

18. The dispenser device of claim 17, wherein the plurality of discs may be rotated in order to be unscrewed from the screw shaft.

19. The dispenser device of claim 13, wherein the receptacle comprises a thread recess and wherein the disc assembly is retained in the thread recess.

* * * * *